US006837779B2

(12) United States Patent
Smith et al.

(10) Patent No.: US 6,837,779 B2
(45) Date of Patent: Jan. 4, 2005

(54) CHEMICAL MECHANICAL POLISHER WITH GROOVED BELT

(75) Inventors: Christopher W. Smith, Los Altos Hills, CA (US); John M. White, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 62 days.

(21) Appl. No.: 09/851,185

(22) Filed: May 7, 2001

(65) Prior Publication Data

US 2002/0164936 A1 Nov. 7, 2002

(51) Int. Cl.[7] ..... B24B 21/02

(52) U.S. Cl. ..... 451/307; 451/41; 451/60; 451/285; 451/286; 451/287; 451/296; 451/303; 451/305; 451/306

(58) Field of Search ..... 451/41, 60, 285, 451/286, 287, 296, 303, 305, 306, 307

(56) References Cited

U.S. PATENT DOCUMENTS

| | | | | |
|---|---|---|---|---|
| 5,020,283 | A | | 6/1991 | Tuttle |
| 5,131,190 | A | | 7/1992 | Gougouyan |
| 5,177,908 | A | | 1/1993 | Tuttle |
| 5,190,568 | A | | 3/1993 | Tselesin |
| 5,216,843 | A | | 6/1993 | Breivogel et al. |
| 5,297,364 | A | | 3/1994 | Tuttle |
| 5,329,734 | A | | 7/1994 | Yu |
| 5,394,655 | A | | 3/1995 | Allen et al. |
| 5,421,769 | A | | 6/1995 | Schultz et al. |
| 5,489,233 | A | | 2/1996 | Cook et al. |
| 5,527,215 | A | | 6/1996 | Rubino et al. |
| 5,558,563 | A | | 9/1996 | Cote et al. |
| 5,578,362 | A | | 11/1996 | Reinhardt et al. |
| 5,645,469 | A | | 7/1997 | Burke et al. |
| 5,650,039 | A | | 7/1997 | Talieh |
| 5,888,121 | A | | 3/1999 | Kirchner et al. |
| 5,921,855 | A | | 7/1999 | Osterheld et al. |
| 5,984,769 | A | | 11/1999 | Bennett et al. |
| 6,063,215 | A | * | 5/2000 | Harrington ..... 148/622 |
| 6,273,806 | B1 | | 8/2001 | Bennett et al. |
| 6,315,857 | B1 | * | 11/2001 | Cheng et al. ..... 156/345.12 |

FOREIGN PATENT DOCUMENTS

| | | |
|---|---|---|
| WO | WO 97/20660 | 6/1997 |
| WO | WO 98/45090 | 10/1998 |
| WO | WO 98/49723 | 11/1998 |
| WO | WO 99/06182 | 2/1999 |

* cited by examiner

*Primary Examiner*—Joseph J. Hail, III
*Assistant Examiner*—Shantese McDonald
(74) *Attorney, Agent, or Firm*—Fish & Richardson

(57) ABSTRACT

A chemical mechanical polishing apparatus has a substrate holder, a polishing belt, and a backing member positioned on a side of the polishing belt opposite the substrate holder. The polishing belt has a polishing surface to contact at least a portion of the substrate held by the substrate holder. The polishing belt is movable in a first direction in a generally linear path relative to the substrate. The polishing belt has a plurality of grooves formed therein.

25 Claims, 3 Drawing Sheets

CHEMICAL MECHANICAL POLISHER WITH GROOVED BELT

BACKGROUND

The present invention relates to chemical mechanical polishing. More particularly, the present invention relates to apparatus and methods for chemical mechanical polishing of substrates using a belt.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar.

Chemical mechanical polishing (CMP) is one accepted method of planarizing a substrate. This method typically requires that the substrate be mounted on a carrier head. The exposed surface of the substrate is placed against a rotating polishing pad or moving polishing belt. The carrier head provides a controllable load, i.e., pressure, on the substrate to push it against the polishing pad. In addition, the carrier head may rotate to provide additional motion between the substrate and polishing surface. In addition, a polishing slurry, including at least one chemically-active agent, may be supplied to the polishing pad. Unless a fixed abrasive polishing pad is used, the slurry should also contain abrasive particles.

One problem in CMP relates to slurry distribution. The CMP process is fairly complex, requiring the interaction of the polishing pad, abrasive particles and reactive agent with the substrate. Accordingly, ineffective distribution of the slurry across the surface of the polishing pad provide less than optimal polishing results. Rotatable polishing pads have been used which include perforations about the pad. The perforations, when filled, distribute slurry in their respective local region as the polishing pad is compressed. This method of slurry distribution has limited effectiveness because each perforation in effect acts independently. Thus, some of the perforations may have too little slurry, while others may have too much slurry. Furthermore, there is no way to directly channel the excess slurry to where it is needed.

Another problem in CMP is "glazing" of the conventional (non-fixed abrasive) rotatable polishing pad. Glazing occurs when the polishing pad is heated and compressed in regions where the substrate is pressed against it. The roughened surface of the polishing pad is smoothed out and the perforations in the polishing pad are filled up, so the surface of the polishing pad becomes less abrasive. As a result, the polishing time required to polish a substrate increases. Therefore, the polishing pad surface must be periodically conditioned to maintain a high throughput.

In addition, during the conditioning process, waste materials associated with abrading the surface of the pad may fill or clog the perforations in the polishing pad. Filled or clogged perforations can not hold slurry, thereby reducing the effectiveness of the polishing process.

SUMMARY

In one aspect, the invention is directed to a chemical mechanical polishing apparatus that has a substrate holder, a polishing belt, and a backing member positioned on a side of the polishing belt opposite the substrate holder. The polishing belt has a polishing surface to contact at least a portion of the substrate held by the substrate holder while the polishing belt is moving in a first direction in a generally linear path relative to the substrate. The polishing belt has a plurality of grooves formed therein, the grooves having a depth of at least about 0.02 inches, a width of at least about 0.015 inches, and a pitch of at least about 0.09 inches.

Implementations of the invention may include one or more of the following features. The grooves may be uniformly spaced over the polishing surface. The grooves have a depth between about 0.02 and 0.05 inches, e.g., approximately 0.03 inches, a width between about 0.015 and 0.04 inches, e.g., approximately 0.02 inches, and a pitch between about 0.09 and 0.24 inches, e.g., approximately 0.12 inches. An actuator may urge the substrate and the belt into contact with one another for polishing. A fluid layer may be interposed between the membrane backing member and the polishing belt. The belt may have a width at least as wide as the substrate holder. The belt may be driven continuously during polishing, or may be driven periodically between polishing operations. The belt may be continuous belt, or it may extend between a feed and a take-up roller. The grooves may be oriented substantially perpendicular to the first direction of motion. The grooves may include a first plurality of substantially linear grooves and a second plurality of substantially linear grooves oriented perpendicular to the first plurality of grooves. The grooves may have an arcuate shape curved away from the first direction of motion.

In another aspect, the invention is directed to a chemical mechanical polishing apparatus that has a substrate holder, a polishing belt, and a backing member positioned on a side of the polishing belt opposite the substrate holder. The polishing belt has a polishing surface to contact at least a portion of the substrate held by the substrate holder. The belt is movable in a first direction in a generally linear path relative to the substrate, and has a plurality of grooves formed therein, the grooves oriented substantially perpendicular to the first direction of motion.

Implementations of the invention may include one or more of the following features. The plurality of grooves may be substantially linear.

In another aspect, the invention is directed to a chemical mechanical polishing apparatus that has a substrate holder, a polishing belt, and a backing member positioned on a side of the polishing belt opposite the substrate holder. The polishing belt has a polishing surface to contact at least a portion of the substrate held by the substrate holder. The belt is movable in a first direction in a generally linear path relative to the substrate. The polishing belt has a first plurality of substantially linear grooves and a second plurality of substantially linear grooves formed therein. The first plurality of grooves oriented substantially perpendicular to the second plurality of grooves.

Implementations of the invention may include one or more of the following features. The first plurality of grooves may be oriented substantially perpendicular to the first direction, or the first and second pluralities of grooves nay be oriented at about 45 degrees to the first direction.

In another aspect, the invention is directed to a chemical mechanical polishing apparatus that has a substrate holder, a polishing belt, and a backing member positioned on a side of the polishing belt opposite the substrate holder. The polishing belt has a polishing surface to contact at least a portion of the substrate held by the substrate holder. The belt is movable in a first direction in a generally linear path relative to the substrate. The polishing belt has a plurality of arcuate grooves formed therein.

Implementations of the invention may include one or more of the following features. The arcuate grooves may be bowed away from the first direction.

Advantages of the invention may include the following. The grooves of the polishing pad provide an effective way to distribute slurry across the pad. Slurry may be distributed to the substrate more uniformly, thereby providing more uniform polishing across the substrate. The grooves are sufficiently wide that waste material produced by a conditioning process can be flushed from the grooves. The relatively deep grooves also improve the pad lifetime.

DETAILED DESCRIPTION

Figure 1:
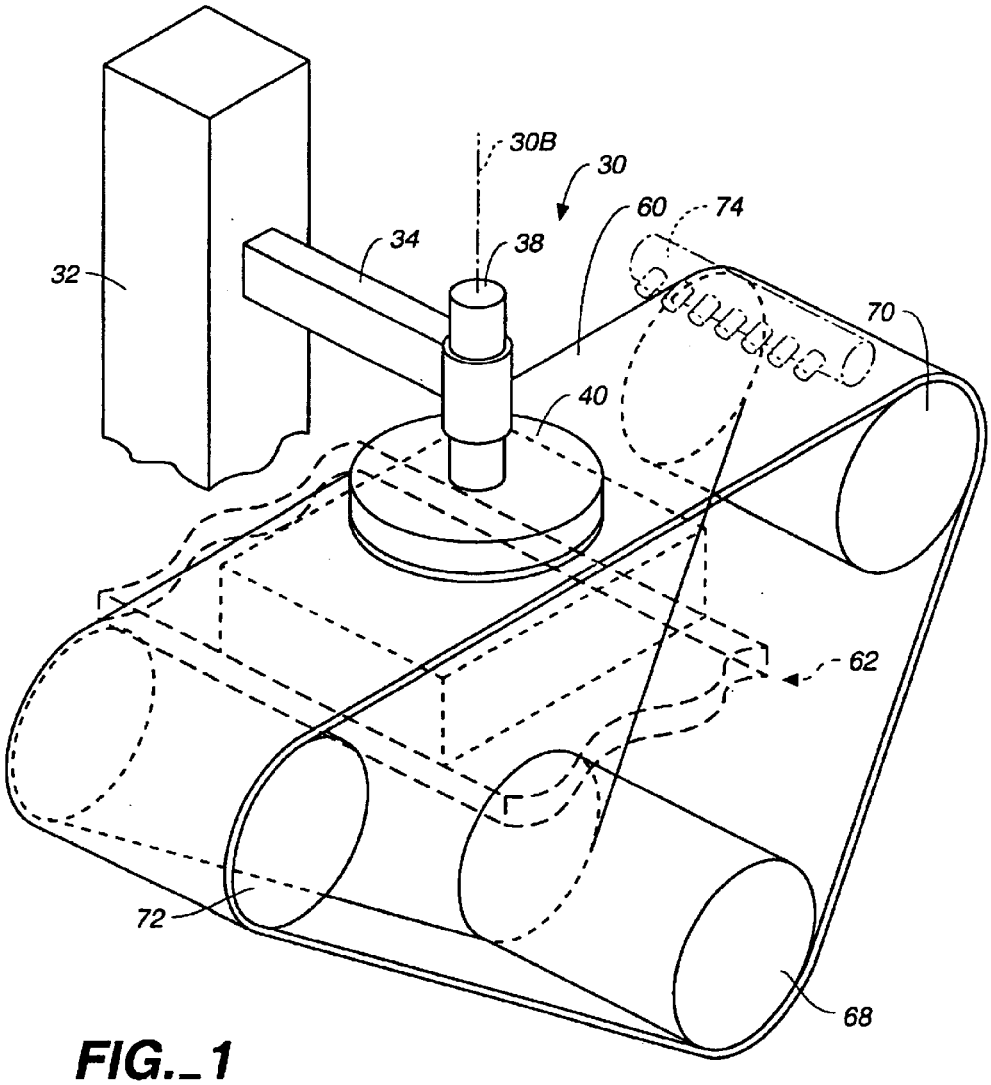
FIG. 1 is a perspective view of a polishing apparatus that includes a continuous polishing belt.

An apparatus of chemical mechanical polishing (CMP) is illustrated in FIG. 1. In this apparatus, a substrate surface is polished by using an abrasive slurry with an active chemical (e.g., an alkaline solution) in combination with a moving polishing belt 60.

A substrate (wafer) holder (polishing head) assembly 30 includes a fixed base 32 connected to a movable support arm or frame 34. The support frame 34 holds a polishing head shaft 38 which supports a polishing head 40. The polishing head shaft 38 can be rotated by a rotation mechanism (not shown) to control the rotation of the polishing head 40. The vertical position of the wafer holding surface of the polishing head 40 can be controlled, e.g., by a pressure chamber in the polishing head 40 or by a vertical actuator coupled to the polishing head shaft 38.

The polishing belt 60 is routed around three rollers 68, 70 and 72. During polishing, the belt moves continuously in a longitudinal direction between the top two rollers, e.g. from roller 70 to roller 72. As the polishing belt 60 moves, an abrasive liquid slurry is distributed over the width of the belt 60 by a distribution manifold 74. Alternately, the chemical can be applied to the polishing belt at another location, e.g., by using spray nozzles (not shown). A chemical, e.g., an alkaline such as NaOH or KOH for oxide polishing, to control the polishing rate can be part of the slurry. As the slurry on the polishing belt 60 contacts the substrate held by the polishing head 40, chemical mechanical polishing of the substrate occurs.

A backing assembly 62 (shown in phantom in FIG. 1) is positioned adjacent to the belt 60 at a location directly opposite to the polishing head 40. The moving belt is sandwiched between the polishing head 40 and the membrane backing assembly 62. The backing assembly 62 assists in providing a uniform contact pressure between the belt 60 and the substrate. A conformable plate (not shown) can be molded over the top of the backing assembly 62. In addition, to reduce or eliminate wear between the bottom of the belt 60 and the backing assembly 62, a pressurized fluid of either gas or liquid is provided through holes to create a fluid bearing. The fluid or gas creating this layer is continuously replenished so that the thickness of the layer remains generally constant as the liquid or gas escapes sideways.

An unillustrated conditioning mechanism periodically or continuously abrades the polishing belt to return the polishing surface to a rough condition.

The substrate and polishing head 40 can be rotated by a rotating mechanism, and can also be oscillated across the width of the belt 60. Such rotation and oscillatory movement prevents surface defects and anomalies in the polishing belt 60 from creating a corresponding anomalies in the surface of the substrate. Slow rotation of the polishing head 40 (providing a diametral speed which is less than 1/100th of the translational speed of the belt 60) distributes the action of a defect on the surface of the belt over the surface of the substrate to help minimize its effect. If the polishing head moves at a rate of 100 ft/min then the rotation of the polishing head for an eight inch wafer should be about 1 rpm or provide a 100:1 ratio between the movement of the belt versus the movement related to the rotation of the substrate.

Figure 2:
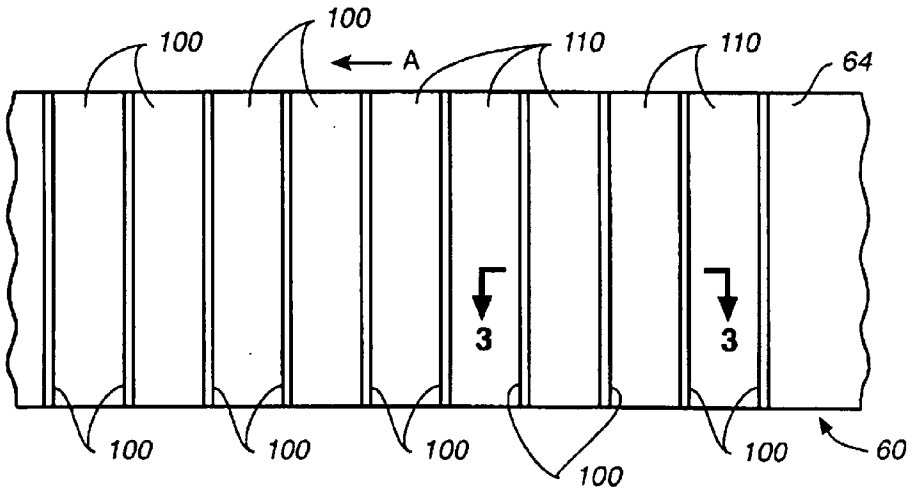
FIG. 2 is a top view of the polishing belt from FIG. 1.
Figure 3:
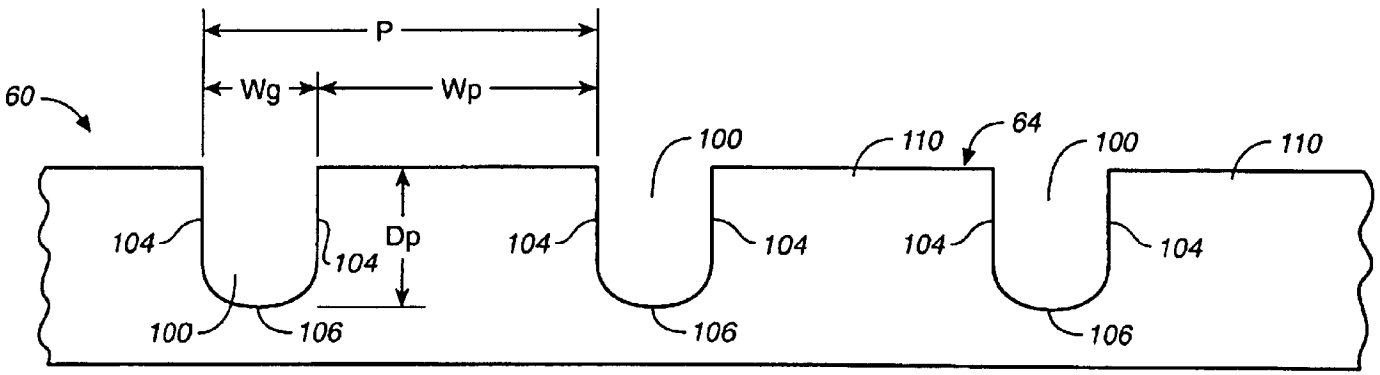
FIG. 3 is a cross-sectional view of the polishing belt of FIG. 2 taken along line 3—3.

Referring to FIGS. 2 and 3, the polishing belt 60 can be composed of a layer of polyurethane or polyurethane mixed with a filler. The polishing belt has a roughened durable polishing surface 64. The polishing belt 60 can also include a second layer of a more compressible or flexible material bonded to an lower surface of the polyurethane layer.

A plurality of generally parallel linear grooves 100 are disposed in the polishing surface 64 of the polishing belt 60. The linear grooves are oriented perpendicular to the direction of motion (shown by arrow A) of the polishing belt during polishing. The grooves are uniformly spaced with a pitch P. Each groove can have a depth Dg and a width Wg. Each groove 100 includes generally perpendicular walls 104 which terminate in a substantially U-shaped base portion 106. Between each groove is a partition 110 having a width Wp.

During polishing, slurry dispensed by the distribution manifold 74 onto the polishing belt 60 accumulates in the linear grooves 100, and is carried beneath carrier head 40 into contact with the exposed surface of the substrate.

Each polishing cycle results in wear of polishing belt 60, generally in the form of thinning of the polishing belt due to conditioning. The width Wg of a groove with substantially perpendicular walls 104 does not change as the polishing belt is worn. Thus, the generally perpendicular walls ensure that the polishing pad has a substantially uniform surface area over its operating lifetime.

The polishing belt of the present invention include relatively wide and deep grooves. The grooves 100 have a minimum width Wg of about 0.015 inches. Each groove 100 can have a width Wg between about 0.015 and 0.04 inches. Specifically, the grooves can have a width Wg of approximately 0.020 inches. Each partition 110 can have a width Wp between about 0.075 and 0.20 inches. Specifically, the partitions can have a width Wp of approximately 0.10 inches. Accordingly, the pitch P between the grooves can be between about 0.09 and 0.24 inches. Specifically, the pitch can be approximately 0.12 inches.

The ratio of groove width Wg to partition width Wp can be selected to be between about 0.10 and 0.25. The ratio can be approximately 0.2. If the grooves are too wide, the polishing pad will be too flexible. On the other hand, if the grooves are too narrow, it becomes difficult to remove waste material from the grooves. Similarly, if the pitch is too small, the grooves will be too close together and the polishing pad will be too flexible. On the other hand, if the pitch is too large, slurry will not be evenly transported to the entire surface of the substrate.

The grooves 100 also have a depth Dg of at least about 0.02 inches. The depth Dg can be between about 0.02 and 0.05 inches. Specifically, the depth Dg of the grooves can be approximately 0.03 inches. Upper layer can have a thickness T between about 0.06 and 0.12 inches. As such, the thickness T can be about 0.07 inches. The thickness T should be selected so that the distance Dp between the bottom of base portion 106 and lower layer is between about 0.035 and 0.085 inches. Specifically, the distance Dp can be about 0.04 inches. If the distance Dp is too small, the polishing pad will be too flexible. On the other hand, if the distance Dp is too large, the polishing pad will be thick and, consequently, more expensive.

The grooves 100 also have a depth Dg of at least about 0.02 inches. The depth Dg can be between about 0.02 and 0.05 inches. Specifically, the depth Dg of the grooves can be approximately 0.03 inches. Upper layer can have a thickness T between about 0.06 and 0.12 inches. As such, the thickness T can be about 0.07 inches. The thickness T should be selected so that the distance Dp between the bottom of base portion 106 and lower layer is between about 0.035 and 0.085 inches. Specifically, the distance Dp can be about 0.04 inches. If the distance Dp is too small, the polishing pad will be too flexible. On the other hand, if the distance Dp is too large, the polishing pad will be thick and, consequently, more expensive.

Figure 4A:
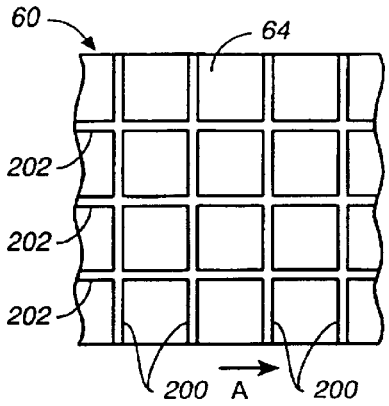
FIG. 4A is a top view of an implementation of the polishing belt using cross-hatched grooves.
Figure 4B:
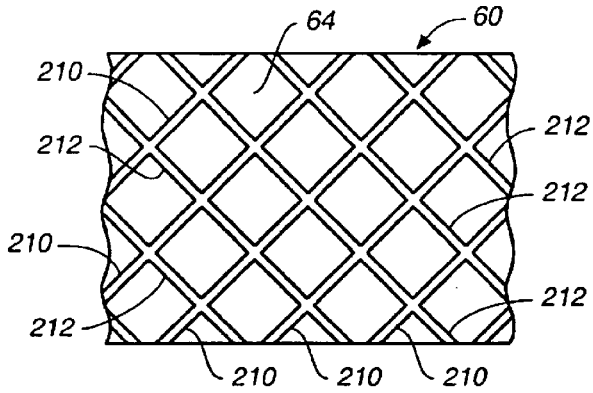
FIG. 4B is a top view of an implementation of the polishing belt using diagonal grooves.

Referring to FIG. 4A, in another implementation, two sets of generally linear grooves 200 and 202 are disposed in the polishing surface 64 of the polishing belt 60. The first set of grooves 200 can be oriented perpendicular to the second set of grooves 202. For example, the first set of grooves 200 can be oriented perpendicular to the direction of motion (shown by arrow A) of the polishing belt, whereas the second set of grooves can be oriented parallel to the direction of motion. Alternatively, referring to FIG. 4B, two sets of generally linear grooves 210 and 212 can be oriented at a 45 degree angle to the direction of motion of the polishing belt.

Figure 4C:
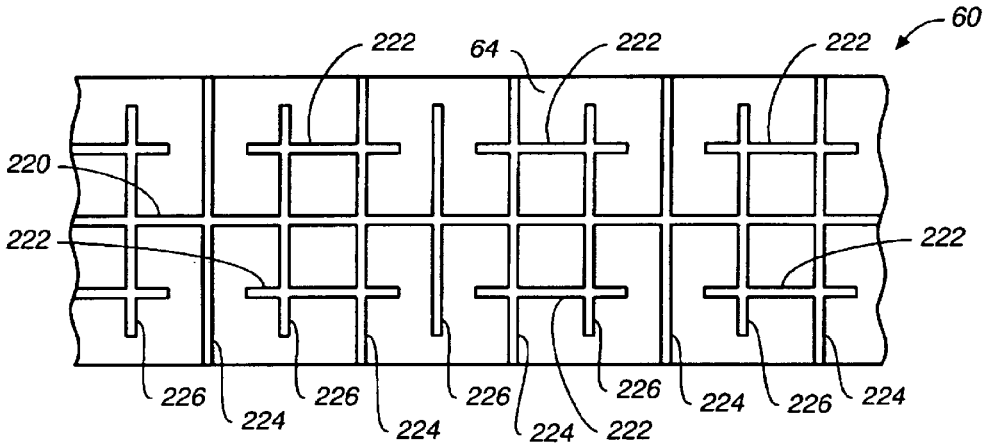
FIG. 4C is a top view of an implementation of the polishing belt using discontinuous grooves.

Some or all of the grooves can have discontinuities. In particular, grooves that are oriented parallel to the direction of motion of the polishing pad can be discontinuous. This can assist in transporting the slurry to the substrate. For example, referring to FIG. 4C, grooves 220 and 222 are oriented parallel to the direction of motion, and grooves 222 are discontinuous.

In addition, some or all of the grooves can end before the edge of the polishing belt. For example, referring to FIG. 4C, grooves 224 and 226 are oriented perpendicular to the direction of motion of the polishing pad. Grooves 224 extend to the edge of the pad, whereas grooves 226 do not. Two portions along the opposite edges of the belt can be entirely free of grooves.

Figure 5:
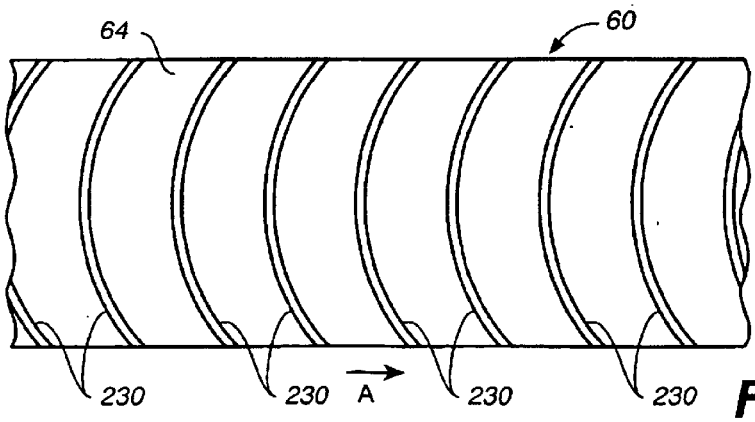
FIG. 5 is a top view of an implementation of the polishing belt using arcuate grooves.

Referring to FIG. 5, in another implementation, a set of arcuate grooves 230 are disposed in the polishing surface 64 of the polishing belt 60. The arcuate grooves 230 can be bowed away from the direction of motion (shown by arrow A) of the polishing belt. The arcuate grooves 230 can be generally equidistant, with the pitch, width and depth described for the implementation of FIG. 2. However, in the implementation of FIG. 5, the curved shape of the groove counteracts the forces that tend to urge the slurry toward and off the edge of the polishing pad. Thus, the curved grooves 230 tend to retain more slurry and, consequently, less slurry needs to be supplied to the polishing pad, thereby reducing the cost of consumables for the polishing machine. These grooves can also be discontinuous and do not need to extend to the edge of the polishing pad.

The belt has been described as a continuous belt that moves during polishing to create relative motion between the polishing surface and the substrate. However, the invention may also be applicable to a CMP machine in which the belt is driven between a feed roller and a take-up roller. In addition, the invention may also be applicable to a CMP machine that incrementally advances the belt between polishing operations, and then either orbits the carrier head or rotates a backing assembly that holds the belt in order to create relative motion between the substrate and polishing surface. Such polishing machines are described in U.S. patent application Ser. No. 09/244,456, filed Feb. 4, 1999, Ser. No. 09/796,303, filed Feb. 27, 2001, and Ser. No. 09/302,570, filed Apr. 30, 1999.

While the invention has been described with regards to specific embodiments, those skilled in the art will recognize that changes can be made in form and detail without departing from the spirit and scope of the invention.

What is claimed is:

1. A chemical mechanical polishing apparatus, comprising:

a substrate holder to hold a substrate;

a polishing belt having a polishing surface to contact at least a portion of the substrate held by the substrate holder while the polishing belt is moving in a first direction in a generally linear path relative to the substrate, the polishing belt having a plurality of grooves formed therein, the grooves oriented substantially perpendicular to the first direction; and a backing member positioned on a side of the polishing belt opposite the substrate holder;

wherein a fluid layer is interposed between the backing member and the polishing belt.

2. The apparatus of claim 1 wherein the grooves are uniformly spaced over the polishing surface.

3. The apparatus of claim 1 wherein the grooves have a depth between about 0.02 and 0.05 inches.

4. The apparatus of claim 3 wherein the grooves have a depth of approximately 0.03 inches.

5. The apparatus of claim 1 wherein the grooves have a width between about 0.015 and 0.04 inches.

6. The apparatus of claim 5 wherein the grooves have a width of approximately 0.02 inches.

7. The apparatus of claim 1 wherein the grooves have a pitch between about 0.09 and 0.24 inches.

8. The apparatus of claim 7 wherein the grooves have a pitch of approximately 0.12 inches.

9. The apparatus of claim 1, further comprising an actuator to urge the substrate and the belt into contact with one another for polishing.

10. The apparatus of claim 1 wherein the belt has a width at least as wide as the substrate holder.

11. The apparatus of claim 1 wherein the belt is driven continuously during polishing.

12. The apparatus of claim 1 wherein the belt is driven periodically between polishing operations.

13. The apparatus of claim 1 wherein the belt is a continuous belt.

14. The apparatus of claim 1 wherein the belt extends between a feed and a take-up roller.

15. A chemical mechanical polishing apparatus, comprising;

a substrate holder to hold a substrate;

a polishing belt having a polishing surface to contact at least a portion of the substrate held by the substrate holder while the polishing belt is moving in a first direction in a generally linear path relative to the substrate, the polishing belt having a first plurality of grooves formed therein, the first plurality of grooves oriented substantially perpendicular to the first direction and a second plurality of grooves oriented substantially perpendicular to the first plurality of grooves; and a backing member positioned on a side of the polishing belt opposite the substrate holder.

16. A chemical mechanical polishing apparatus, comprising:

a substrate holder to hold a substrate;

a polishing belt having a polishing surface to contact at least a portion of the substrate held by the substrate holder while the polishing belt is moving in a first direction in a generally linear path relative to the substrate, the polishing belt having a plurality of grooves formed therein, the grooves oriented substantially perpendicular to the first direction wherein the grooves include only one arcuate shape; the arcuate shape being curved away from the first direction of motion; and a backing member positioned on a side of the polishing belt opposite the substrate holder.

17. A chemical mechanical polishing apparatus, comprising:

a substrate holder to hold a substrate;

a polishing belt having a polishing surface to contact at least a portion of the substrate held by the substrate holder, the polishing belt movable in a first direction in a generally linear path relative to the substrate, the polishing belt having a first plurality of substantially linear grooves and a second plurality of substantially linear grooves formed therein, the first plurality of grooves oriented substantially perpendicular to the second plurality of grooves; and a backing member positioned on a side of the polishing belt opposite the substrate holder.

18. The apparatus of claim 17 wherein the first plurality of grooves is oriented substantially perpendicular to the first direction.

19. The apparatus of claim 17 wherein the first and second pluralities of grooves are oriented at about 45 degrees to the first direction.

20. A substrate polishing article, comprising:

a polishing belt having a polishing surface configured to polish at least a portion of a substrate during polishing of the substrate, the polishing belt having a width and a length, wherein the length is greater than the width; and a first plurality of grooves formed in the polishing surface, the grooves oriented substantially perpendicular to the length of the polishing belt and a second plurality of grooves oriented substantially perpendicular to the first plurality of grooves.

21. The article of claim 20, wherein the first plurality of grooves includes substantially linear grooves and the second plurality of grooves includes substantially linear grooves.

22. The article of claim 20, wherein the polishing belt is a continuous belt.

23. The article of claim 20, wherein the polishing belt has a take-up end and a feed end.

24. The article of claim 20, wherein the polishing belt comprises a layer including polyurethane.

25. A substrate polishing article, comprising:

a polishing belt having a polishing surface configured to polish at least a portion of a substrate during polishing of the substrate, the polishing belt having a width and a length, wherein the length is greater than the width, the polishing belt having a plurality of grooves formed therein, the grooves oriented substantially perpendicular to the length of the polishing belt, wherein each groove includes only one arcuate shape that bows in a direction parallel to the length of the polishing pad.

* * * * *

UNITED STATES PATENT AND TRADEMARK OFFICE

CERTIFICATE OF CORRECTION

PATENT NO. : 6,837,779 B2
APPLICATION NO. : 09/851185
DATED : January 4, 2005
INVENTOR(S) : Christopher W. Smith and John M. White It is certified that error appears in the above-identified patent and that said Letters Patent is hereby corrected as shown below:

On the Title Page, (56) References Cited, U.S. PATENT DOCUMENTS; add:

| | | | | |
|---|---|---|---|---|
| --6,238,271 | B1 | * | 5/2001 | Cesna |
| 6,302,767 | B1 | * | 10/2001 | Tietz |
| 6,406,363 | B1 | * | 6/2002 | Xu et al.-- |

Signed and Sealed this

Second Day of October, 2007

JON W. DUDAS
*Director of the United States Patent and Trademark Office*